United States Patent [19]

Omessi

[11] Patent Number: 4,736,920

[45] Date of Patent: Apr. 12, 1988

[54] ATTACHMENT FOR HOSPITAL BEDS

[76] Inventor: Benjamin Omessi, 900 N. Lake Shore Dr., Chicago, Ill. 60611

[21] Appl. No.: 832,969

[22] Filed: Feb. 25, 1986

[51] Int. Cl.[4] ..... A47K 1/08

[52] U.S. Cl. ..... 248/311.2; 5/503; 5/508; 211/71; 215/100 A

[58] Field of Search ..... 248/311.2, 309.2, 214, 248/224.4, 224.3; 5/503, 504, 508, 60; 297/188, 194; 211/13, 75, 71; 215/100 A; 206/806

[56] References Cited

U.S. PATENT DOCUMENTS

| | | | |
|---|---|---|---|
| 1,115,492 | 11/1914 | Bond | 248/224.3 X |
| 2,890,801 | 6/1959 | Ladd et al. | 248/224.3 X |
| 3,170,665 | 2/1965 | Ryan | 248/311.2 |
| 3,880,311 | 4/1975 | McPhee | 215/100 A X |
| 4,186,903 | 2/1980 | Fazakerley | 248/231.2 X |
| 4,489,454 | 12/1984 | Thompson | 5/508 X |
| 4,573,653 | 3/1986 | Boettger | 248/311.2 X |

*Primary Examiner*—J. Franklin Foss
*Assistant Examiner*—David L. Talbott
*Attorney, Agent, or Firm*—Laff, Whitesel, Conte & Saret

[57] ABSTRACT

An attachment for hospital beds has a post which may be placed in any existing socket or other support for a device such an an IV bottle. While these sockets or supports are usually found on hospital beds, they are also found on X-ray tables, chairs, and the like. The inventive post has a horizontal arm with a vertical height or thickness so that the handle of a bottle may be hung over the arm. The vertical height or thickness will keep the bottle in an upright position and prevent it from rotating around the arm. The outer tip end of the arm is relatively pointed and the underside of the arm tapers downwardly. Therefore, a closed or U-shaped handle which is attached at both of its ends to an object may be slipped over the point and it will slide along the arm as far as permitted by the tapered underside to reach a stable vertically supporting position.

8 Claims, 1 Drawing Sheet

ATTACHMENT FOR HOSPITAL BEDS

This invention relates to hospital equipment and, more particularly, to attachments for hospital beds, and the like.

Existing hospital equipment includes many standard features which are already provided for the convenience of the staff of doctors, nurses, attendants, and the like. One of these features relates to sockets or other anchor points for enabling an installation of overhead equipment for serving a patient's needs. An example of such equipment is a support for IV or intravenous bottles.

Other equipment used in hospitals includes many different kinds of bottles or other containers having handles which may be used to manipulate the container, while it is being used. An example of such a bottle is a urinal, which currently is likely to be a molded plastic bottle with a cantilever handle that is attached at its upper end to the bottle. The lower end of the handle is free and unattached on this particular kind of a bottle, although other bottles sometimes have handles which are attached on both ends.

A problem which is common to most hospitals is that there is no convenient place to set these bottles and containers, especially after use. Therefore, they are usually placed on the same tray or table that is used to support a dish for food, a container for medicine, and sometimes the medicine without the container. Other times, the bottles are placed on the floor where they might be kicked; or they may be placed in some out of the way place where they could be forgotten. Cantilever handle urinal bottles are commonly hung from bed siderails. When lowered, the urinal bottle falls off causing a urine spill.

Accordingly, an object of the invention is to provide new and improved means for and methods of suspending bottles, and the like, in a convenient, out of the way place where they cannot be lost. Here, an object is to improve sanitation by removing the incentive to place filled urinals on the same tables that are used for dispensing food, medicine, or the like. In this connection, an object is to improve services by eliminating carelessly placed containers which might be kicked, spilled, lost, etc.

Another object is to solve these and other problems by a multi-purpose device which may be added to or used with existing hospital equipment, without requiring a modification thereof.

In keeping with an aspect of the invention, these and other objects are accomplished by a post which may be placed in any existing socket or other support for an IV bottle. Usually, these sockets or supports are on hospital beds; however, they are also found on X-ray tables, chairs, and the like. The inventive post has an arm with a vertical height or thickness so that the handle of a bottle may be hung over the arm. The vertical height or thickness will keep the bottle in an upright position and prevent it from rotating around the arm. The outer tip end of the arm is relatively pointed and the underside of the arm tapers downwardly. Therefore, a closed or U-shaped handle, which is attached at both of its ends to a bottle, may be slipped over the point. It will slide along the arm as far as permitted by the tapered underside to reach a stable, vertically supporting position.

A preferred embodiment which provides these features is shown in the attached drawings wherein:

FIG. 3 is a side elevation of the inventive post for supporting bottles, and the like;

Figure 1:
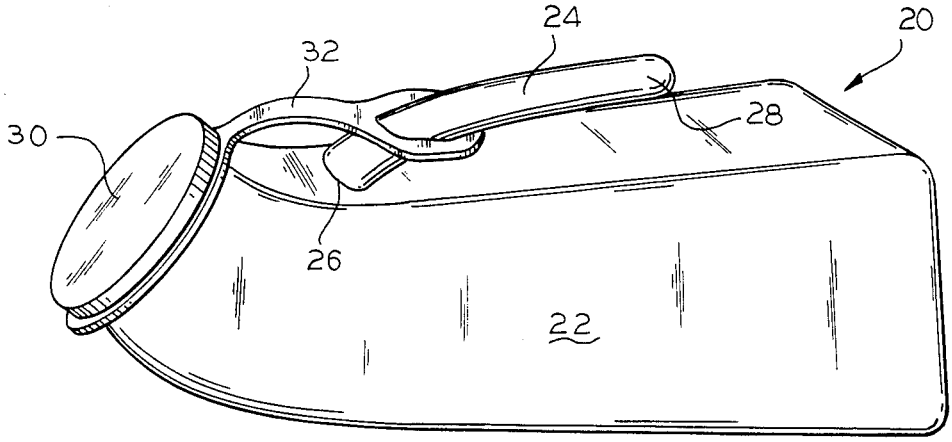
FIG. 1 is a perspective view of an exemplary bottle which may be used on the inventive support.

By way of example, FIG. 1 shows a conventional plastic bottle 20 of a type that might be used on or in connection with the inventive stand. This particular type of bottle has a blow molded body 22 with a cantilevered handle 24 which is attached on one end 26 to the bottle and which is open and free on the other end 28. This bottle has a cap 30 with an integral strap 32 that slips over the free end 28 of the handle 24 and is captured by a particular shape near the point 26 where handle 24 joins the bottle. This particular bottle 22 is often used as a urinal.

A second type of bottle 36 (FIG. 2) is often used as a milk bottle, usually in the gallon size. This is also a blow molded bottle; however, it has a closed or U-shaped handle 38 which is attached to the bottle 36 at both of its opposite ends. This type of bottle has a completely enclosed window or opening 40 for receiving the fingers of a person who is holding the bottle.

Figure 3:
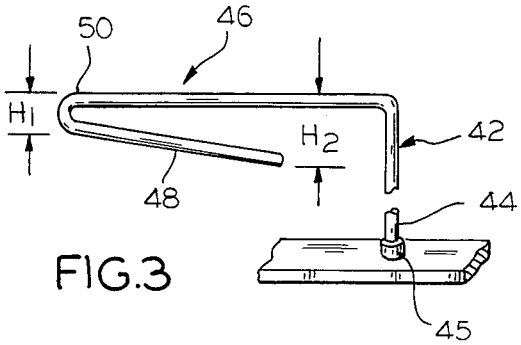

The inventive post 42 (FIG. 3) is a rod or tube which has a straight vertical section that terminates on its lower or free end 44 in a member which fits into a standard socket 45 for holding an IV support. The upper end of post 42 terminates in a horizontal arm 46 formed by bending the rod or tube to a 90° angle. The arm 46 has a tapering underside 48. The free end 50 of arm 48 begins where the rod or tube is bent back upon itself with an acute angle forming a somewhat pointed configuration and tapering to provide an underside 48 which gradually increases the vertical height of arm 46, from a minimum height $H_1$ to a maximum height $H_2$ which should not exceed the length of bottle 20. The minimum height $H_1$ formed by acute angle 50 is small enough so that it will easily thread through the window or opening 40 forming the closed or U-shaped handle 38.

Figure 4:
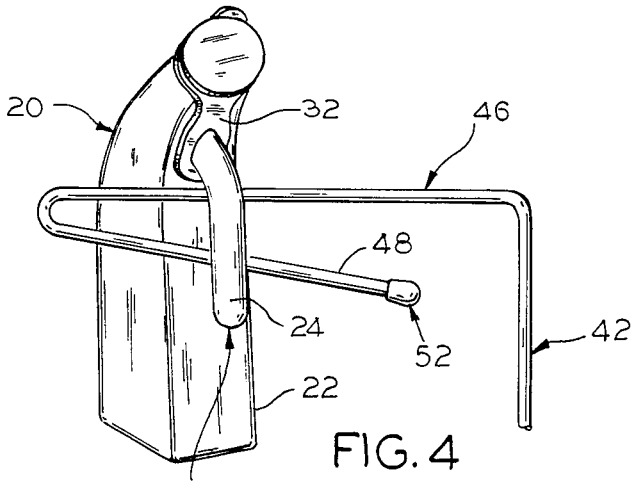
FIG. 4 is a fragmentary side elevation showing the arm of the inventive stand with a bottle having a cantilever handle mounted thereon.
Figure 5:
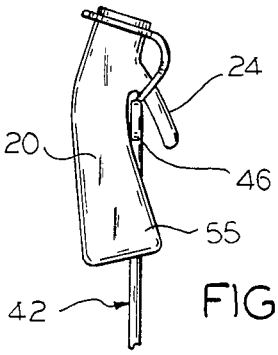
FIG. 5 is a side elevation of FIG. 4, showing how the bottle hangs in a manner which causes an interference with the post to keep it from falling off an end of its supporting arm.

FIG. 4 illustrates how the bottle 20 may be hung over the arm 46. The lowest point 52 on the tapered underside of arm 46 is higher than the bottom of bottle 20. Tip end 52 is covered by a plastic end. Therefore, the bottle 20 may be hung at any point along the length of th arm 46 and the bottle will remain in an upright and stable position. The distance between low point 52 and the vertical post 42 is such that bottle 20 cannot slip off the inner end of arm 46 because the shape of the bottle causes it to engage and interfere with post 42, as shown at 55 (FIG. 5) when and if it should slide that far along arm 46 and toward the post.

Figure 2:
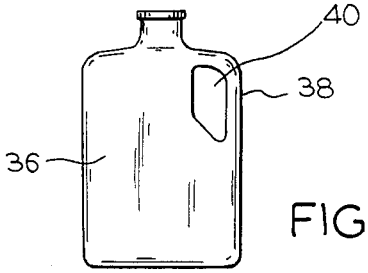
FIG. 2 is a side elevation of a second type of bottle with a closed or U-shaped handle which might use the inventive support.
Figure 6:
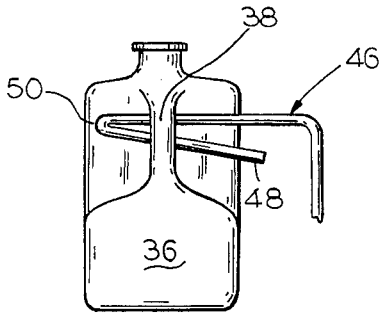
FIG. 6 is a fragmentary side elevation of the inventive arm with a bottle of FIG. 2 having a closed or U-shaped handle hung hereon.

FIG. 6 illustrates the same inventive arm with the bottle 36 of FIG. 2 hung thereon. The tip end 50 of arm 46 has passed through the window 40 (FIG. 2). The bottle may slide along the length of arm 46 to any convenient location which is permitted by the taper of the underside 48 of the arm 46. The taper is such that bottle 36 cannot slide off the free end of the underside 48 of arm 46. Also, the width of most bottles that are likely to be used exceeds the distance between the free end of the underside 48 and the post 42.

Figure 7:
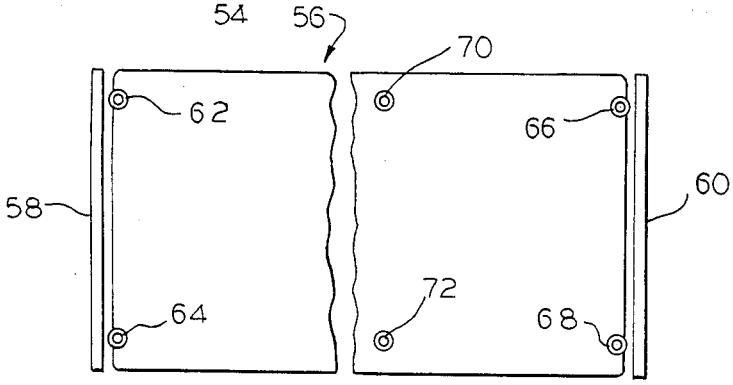
FIG. 7 is a plan view of a hospital bed showing the sockets or points where the inventive support may be mounted.

FIG. 7 shows a plan view of a hospital bed 56 having a head board 58 and footboard 60. The bed 56 is here shown as having six sockets or anchor points 62, 64, 66, 68, 70 and 72 for receiving the post or stand for supporting an IV bottle. These same sockets may also receive the lower or free end of the inventive post 42.

The invention is here shown as being made from a solid rod or tubing which is bent to the described shape. The rod or tubing is preferably made of aluminum or stainless steel. However, it could also be made of any other suitable material, such as molded plastic, for example.

The height of post 42 is preferably such that a patient occupying the bed or a chair can reach arm 46 and place the bottle on it. For this purpose, the post 42 may rotate in socket 45 (FIG. 3) to place the arm 46 in any location which is convenient to the patient. However, when the patient is unable to reach and hang the bottle on the arm 46, the post 42 may be longer to be convenient for a nurse or attendant who is standing close to the patient.

Those who are skilled in the art will readily perceive how to modify the invention. Therefore, the appended claims are to be construed to cover all equivalent structures which fall within the true scope and spirit of the invention.

What is claimed is:

1. A urinal support for attachment to an IV socket on a hospital bed, said support comprising a rod or tube having a straight section forming a vertical post, a horizontal arm formed by a section of said rod or tube which is bent to a 90° angle with respect to said straight section, and a bend at the end of said horizontal arm, said bend being an acute angle which provides an underside arm that returns from a somewhat pointed tip end of said horizontal section toward said straight section, said underside arm being vertically positioned beneath said horizontal sections, said acute angle forming said somewhat pointed tip end to provide a height on said horizontal arm which slips through a window formed by a handle on an object to be hung on said arm, said returning underside arm being spaced from said horizontal section by a distance which does not exceed the length of an object to be hung on said arm, the returning underside arm approaching said post formed by said straight section close enough to prevent said object with said handle from slipping off said underside arm and from sliding beyond said straight section.

2. The attachment of claim 1 wherein said arm has a free end and a tapered underside, said handle is a closed handle having opposite ends joining said object, said free end of said arm fitting through a window formed by said closed handle on said object to be hung on said arm, and said taper being less than the length of said handle on the object to be hung on said arm.

3. The attachment of claim 2 wherein said free lower end of said post rotates in said socket whereby said arm may be swung to a convenient location for a patient.

4. The attachment of claim 3 wherein the height of said vertical post is one which is convenient for a patient resting in said hospital equipment.

5. The attachment of claim 3 wherein the height of said vertical post is one which is convenient for a standing person who is assisting a patient resting in said hospital equipment.

6. The support of claim 1 wherein a free lower end of said rod or tube rotates in said socket whereby said arm may be swung to a convenient location for a patient.

7. The support of claim 6 wherein the height of said vertical post is one which is convenient for a patient resting in said hospital bed.

8. The attachment of claim 6 wherein the height of said vertical post is one which is convenient for a standing person who is assisting a patient resting in said hospital bed.

* * * * *